US008240667B2

(12) United States Patent
Mkrtchyan et al.

(10) Patent No.: US 8,240,667 B2
(45) Date of Patent: Aug. 14, 2012

(54) VOUCHER MANAGEMENT PATH SYSTEM FOR A GAMING MACHINE PRINTER

(75) Inventors: Samson Mkrtchyan, Tarzana, CA (US); Oleg Dymovsky, Los Angeles, CA (US); Mark Meyerhofer, La Canada, CA (US); Eric Meyerhofer, Oceanside, CA (US)

(73) Assignee: Futurelogic, Inc., Glendale, CA (US)

( * ) Notice: Subject to any disclaimer, the term of this patent is extended or adjusted under 35 U.S.C. 154(b) by 4 days.

(21) Appl. No.: 12/554,718

(22) Filed: Sep. 4, 2009

(65) Prior Publication Data

US 2010/0093446 A1 Apr. 15, 2010

Related U.S. Application Data

(60) Division of application No. 10/950,281, filed on Sep. 23, 2004, now abandoned, which is a continuation-in-part of application No. 10/616,811, filed on Jul. 9, 2003, now abandoned.

(60) Provisional application No. 60/396,862, filed on Jul. 18, 2002, provisional application No. 60/394,568, filed on Jul. 9, 2002.

(51) Int. Cl.
*B65H 5/02* (2006.01)

(52) U.S. Cl. ..... 271/273; 271/274; 194/206

(58) Field of Classification Search ..... 271/273, 271/274; 194/206, 207
See application file for complete search history.

(56) References Cited

U.S. PATENT DOCUMENTS

| | | | | |
|---|---|---|---|---|
| 1,794,205 | A | 2/1931 | Ridderstrom | |
| 4,570,923 | A * | 2/1986 | Hooper et al. | 271/275 |
| 5,321,241 | A | 6/1994 | Craine | |
| 5,953,985 | A * | 9/1999 | Kobayashi | 101/116 |
| 6,325,558 | B1 | 12/2001 | Robinson | |
| 6,503,147 | B1 | 1/2003 | Stockdale et al. | |
| 6,578,845 | B2 * | 6/2003 | Chen | 271/273 |
| 7,066,367 | B2 | 6/2006 | Chandaria et al. | |
| 2001/0036866 | A1 | 11/2001 | Stockdale et al. | |
| 2002/0093136 | A1 | 7/2002 | Moody | |
| 2002/0145250 | A1 * | 10/2002 | Chen | 271/273 |
| 2003/0064805 | A1 | 4/2003 | Wells | |
| 2003/0069074 | A1 | 4/2003 | Jackson | |
| 2003/0114217 | A1 | 6/2003 | Walker et al. | |
| 2003/0162589 | A1 | 8/2003 | Nguyen et al. | |

* cited by examiner

*Primary Examiner* — David H Bollinger

(57) ABSTRACT

A gaming machine printer. The gaming machine printer creates printed vouchers, tickets, receipts, etc. for use in gaming applications employing cashless enabled gaming systems. The gaming machine printer includes a voucher management system having a burster bar for separating vouchers and a serpentine voucher guide that may be opened for inspection. The gaming machine printer further includes various electrical features that protect the gaming machine printer from electrostatic discharges.

8 Claims, 17 Drawing Sheets

VOUCHER MANAGEMENT PATH SYSTEM FOR A GAMING MACHINE PRINTER

CROSS-REFERENCE TO RELATED APPLICATIONS

This application is a divisional of U.S. application Ser. No. 10/950,281 filed Sep. 23, 2004, now pending, which is a continuation-in-part of U.S. application Ser. No. 10/616,811 filed Jul. 9, 2003 which claims the benefit of U.S. Provisional Patent Application No. 60/394,568, filed Jul. 9, 2002 and U.S. Provisional Patent Application No. 60/396,862, filed Jul. 18, 2002, each of which are hereby incorporated by reference as if fully stated herein.

BACKGROUND OF THE INVENTION

This invention pertains generally to the field of printers included in automated systems used by consumers and more specifically to printers used in cashless enabled games to generate cash-out vouchers.

The gaming machine manufacturing industry provides a variety of gaming machines for the amusement of gaming machine players. An exemplary gaming machine is a slot machine. A slot machine is an electro-mechanical game wherein chance or the skill of a player determines the outcome of the game. Slot machines are usually found in casinos or other more informal gaming establishments.

Gaming machine manufacturers have more recently introduced cashless enabled games to the market and these have begun to find wide acceptance in the gaming industry. Cashless enabled games are so named because they can conduct financial exchanges using a mixture of traditional currencies and vouchers. Typically, a cashless enabled game has a gaming printer to produce vouchers and a bill acceptor that supports automatic reading of vouchers. To coordinate the activities of multiple cashless enabled games, one or more cashless enabled games may be electronically coupled to a cashless enabled game system that controls the cashless operations of a cashless enabled game.

When a player cashes out using a cashless enabled game coupled to a cashless enabled game system, the cashless enabled game signals the system and the system may determine the type of pay out presented to the player. Depending on the size of the pay out, the cashless enabled game system may cause the cashless enabled game to present coins in the traditional method of a slot machine, or the cashless enabled game system may cause a gaming printer in the cashless enabled game to produce a voucher for the value of the pay out. The voucher may then be redeemed in a variety of ways. For example, the voucher may be redeemed for cash at a cashier's cage or used with another cashless enabled game. In order to use the voucher in a cashless enabled game, the voucher is inserted into a bill acceptor of another cashless enabled game at a participating casino and the cashless enabled game system recognizes the voucher, redeems the voucher, and places an appropriate amount of playing credits on the cashless enabled game.

Cashless enabled games have found an increasing acceptance and use in the gaming industry, both with players who enjoy the speed of play and ease of transporting their winnings around the casino and casinos who have realized significant labor savings in the form of reduced coin hopper reloads in the games, and an increase in revenue because of the speed of play. Practical field experience with printers used in cashless enabled games has illustrated that there are areas for improvement in the current printer designs and implementation. These areas of improvement include prevention of player interference with voucher printing, servicing, and modularity of printer design among others.

SUMMARY OF THE INVENTION

A gaming machine printer creates printed vouchers, tickets, receipts, etc. for use in gaming applications employing cashless enabled gaming systems. The gaming machine printer creates printed vouchers, tickets, receipts, etc. for use in gaming applications employing cashless enabled gaming systems. The gaming machine printer includes a voucher management system having a burster bar for separating vouchers and a serpentine voucher guide that may be opened for inspection. The gaming machine printer further includes various electrical features that protect the gaming machine printer from electrostatic discharges.

In one aspect of the invention, a burster bar for the gaming machine printer includes a top portion having a mounting tab and a bottom portion having a leading edge and a trailing edge with a downardly protruding lip, the downwardly protruding lip defining a bottom surface sloping downward from the leading edge to the trailing edge.

In another aspect of the invention, the gaming machine printer includes an electrostatic discharge device protecting a user accessible device. The electrostatic discharge device is used in a housing having an opening through which a user accesses the user accessible device. A grounded electrostatic discharge pin is mounted in close proximity to the user accessible device and extends through the opening above an upper surface of the housing whereby a user first contacts the electrostatic discharge pin before contacting the user accessible device.

In another aspect of the invention, the gaming machine printer includes a voucher management system. The voucher management system has a lower voucher guide and an upper voucher guide defining a voucher path therebetween, wherein the upper voucher guide is fixedly attached to an inner surface of an openable cover, whereby the upper voucher guide may be separated from the lower voucher guide when the cover is opened, thereby exposing a voucher held in the voucher guide.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
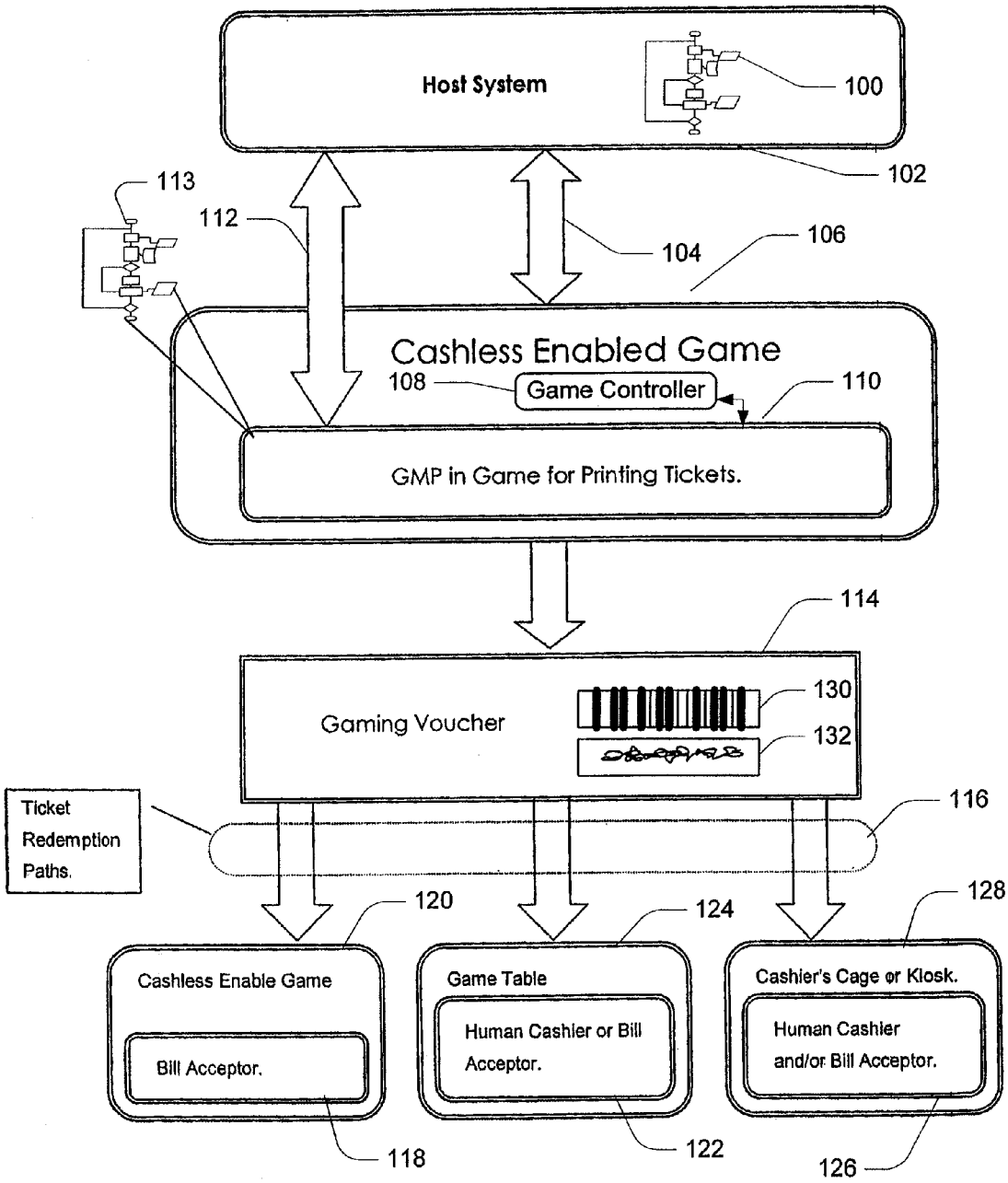
FIG. 1 is a cashless gaming system in accordance with an exemplary embodiment of the present invention.

FIG. 1 is a cashless gaming system in accordance with an exemplary embodiment of the present invention. A cashless gaming system includes a cashless gaming system controller 100 hosted by a system host 102 coupled 104 to one or more cashless enabled games 106. A cashless enabled game includes a game controller 108 that controls the operation of the cashless enabled game. The game controller is coupled to a gaming machine printer 110. The cashless enabled game uses the gaming machine printer to generate tickets and vouchers 114. The gaming machine printer includes heating and printing algorithms 113 in conjunction with special purpose voucher paper. The voucher includes the cash-out information for a player. The gaming machine printer may also be directly coupled 112 to the host system and cashless gaming controller. The voucher may be redeemed 116 in a variety of ways. The voucher may be redeemed by a human cashier or bill acceptor 122 at a game table 124, or a human cashier or bill acceptor 126 at a cashier's cage or kiosk 128, or by a bill acceptor 118 at another cashless enabled game 120. Redemption is only possible after the voucher passes a verification of account information 130 and validation using security signatures 132 included in the voucher.

Figure 2:
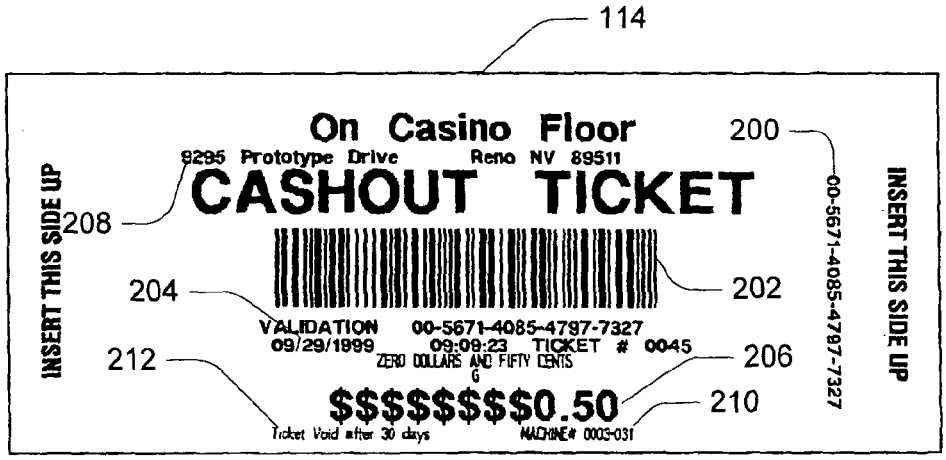
FIG. 2 is an illustration of a voucher in accordance with an exemplary embodiment of the present invention.

FIG. 2 is an illustration of a voucher in accordance with an exemplary embodiment of the present invention. The voucher shown is produced from commands issued by the cashless enabled game to the cashless gaming printer in response to a player's request to cash-out. The voucher 114 includes features such as a validation number, printed in both a human readable form such as a character string 200 and in a machine-readable form such as a bar code 202, time and date stamps 204, cash-out amount 206, casino location information 208, cashless enabled game identifier 210, and an indication of an expiration date 212. The information contained on the voucher is enough to verify that a valid cash-out request was generated at some time, but may not include enough information to detect if a voucher presented for redemption is the original voucher and not a duplicate or forgery.

Figure 3A:
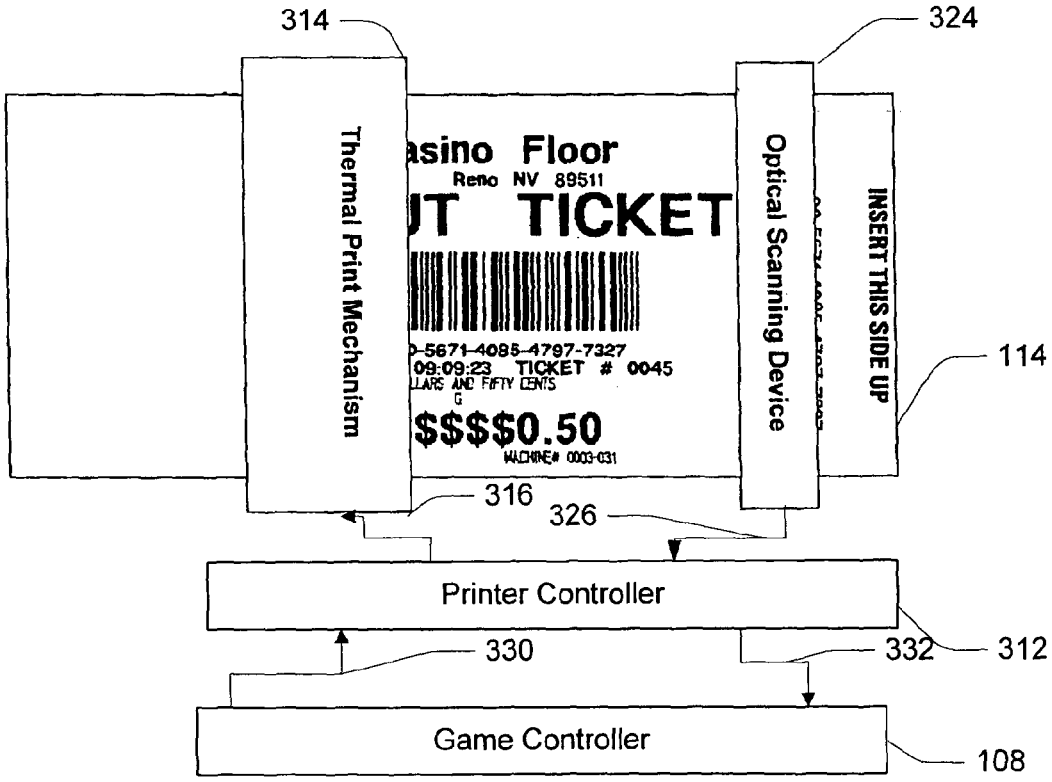
FIG. 3*a* is a semi-schematic diagram of a voucher verification system in accordance with an exemplary embodiment of the present invention.

FIG. 3*a* is a semi-schematic diagram of a voucher verification system in accordance with an exemplary embodiment of the present invention. A voucher verification system 300 is included in a gaming machine printer 106 (FIG. 1). The voucher verification system includes a printer controller 312 operatively coupled to a thermal print mechanism 314 and a optical scanning device 324.

The thermal print mechanism receives thermally reactive voucher paper and generates images on the paper to create a voucher 114. The thermal print mechanism does so by heating a thermal element for each dot that is imaged. The thermal print mechanism typically creates dot images to a granularity of 8 dots per millimeter, each dot image requiring a separate thermal element to create a dot image.

Generally, thermal elements age differently or as a result of their nature or as a result of their usage are different after some usage period. These differences result in variations and undesirable imaging results. Another factor is that the chemistry of the thermally active paper is not a constant. As the chemistry of the thermally active paper varies, so does the quality of the images produced on the thermally active paper resulting in undesirable imaging results. In order to detect when a thermal print mechanism is malfunctioning or thermally active paper is not of good quality, the printer controller uses the optical scanning device to scan completed portions of the images on the voucher as the voucher is being printed. If the printer controller determines that the scanned voucher images includes an error, then the printer controller voids or retrieves the voucher. For example, if the scanned image is too faint or the scanned image is so dark that it is blurry, the printer controller may void the voucher.

In slightly more detail, the printer controller transmits thermal print mechanism control signals 316 to the thermal print mechanism. The thermal print mechanism control signals include voucher printing instructions for generation of the voucher by the thermal print mechanism. The thermal print mechanism uses the voucher printer instructions to print the voucher.

The optical scanning device scans the voucher as the voucher is being printed by the thermal print mechanism. In one embodiment of a optical scanning device in accordance with the present invention, the optical scanning device is a Charged-Coupled Device (CCD) optical scanner. The optical scanning device transmits voucher scan signals 326 to the printer controller.

In one embodiment of a voucher verification system in accordance with the present invention, a game controller 108 is operably coupled to the printer controller. The printer controller receives printer control instructions 330 from the game controller. The printer controller generates voucher verification signals 332 indicating whether or not the voucher has been verified. The printer controller transmits the voucher verification signals to the game controller. The game controller uses the voucher verification signals to determine if the voucher was correctly printed. An exemplary voucher verification system is more fully described in copending U.S. patent application Ser. No. 10/021,624 the contents of which are hereby incorporated by reference as if stated fully herein.

Figure 3B:
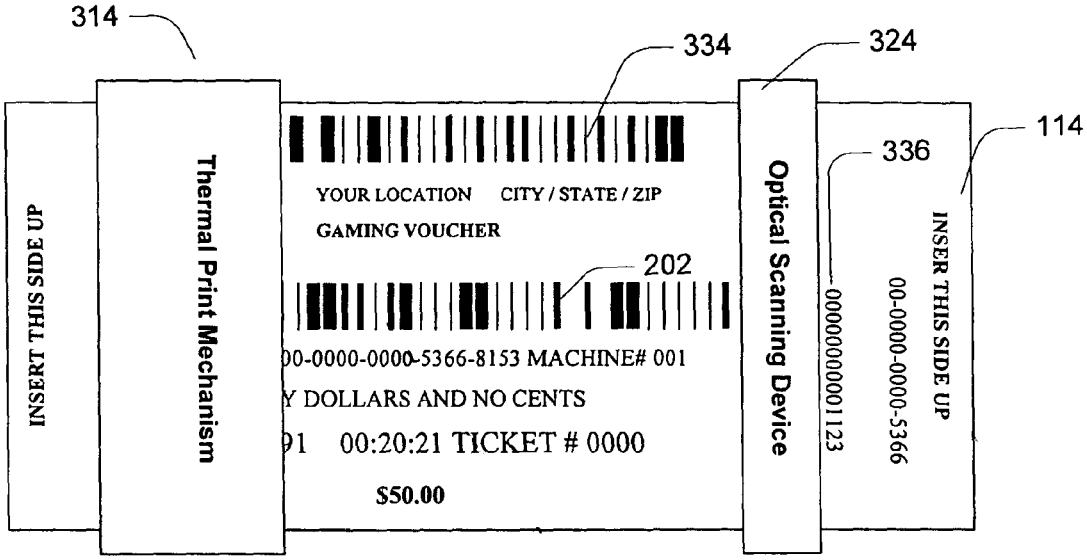
FIG. 3*b* is a semi-schematic diagram of a verification process using additional verification information printed on a voucher in accordance with an exemplary embodiment of the present invention.

FIG. 3*b* is a semi-schematic diagram of a verification process using additional verification information printed on a voucher in accordance with an exemplary embodiment of the present invention. A voucher 114 may further include additional information encoded in a barcode 334 or in text string 336. The additional information is used to augment the information already included on the voucher such as a validation barcode 220. For example, the additional information may be used in the cashless gaming industry to further identify the origin of the voucher by indicating the machine number that printed the voucher. Additional information encoded in barcodes or by other methods may be used to further enhance the security of a cashless gaming process.

In operation, the additional information is printed on the voucher by a thermal print mechanism 314. The additional information may then be verified using an optical scanning device 324 at the time the additional information is added to the voucher.

Figure 4A:
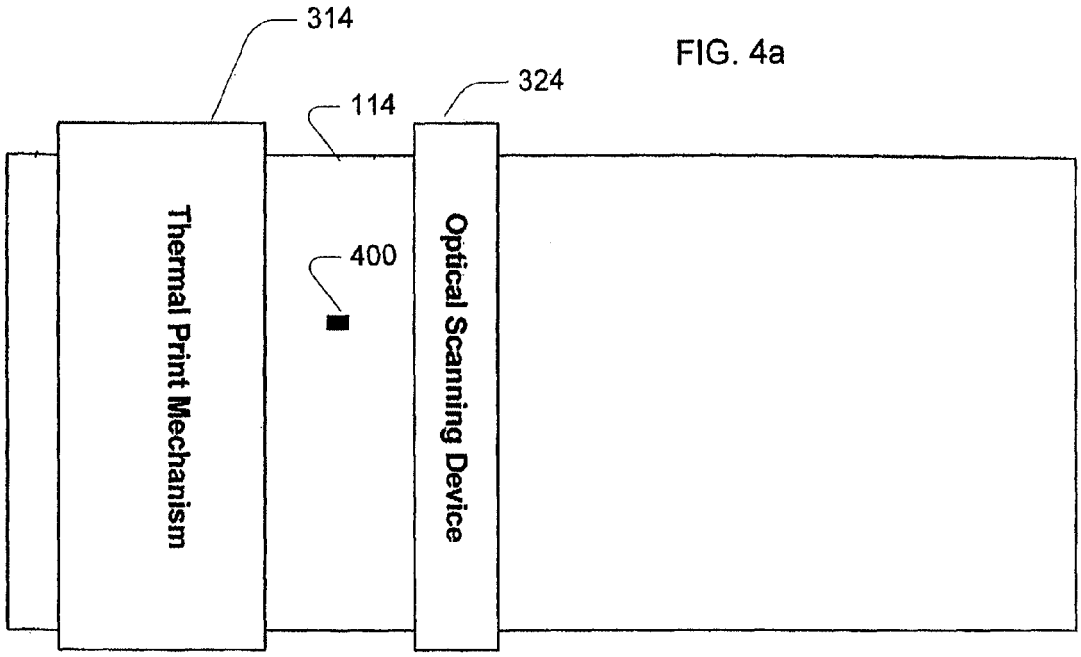
FIG. 4*a* is a semi-schematic view of a calibration process in accordance with an exemplary embodiment of the present invention.
Figure 4B:
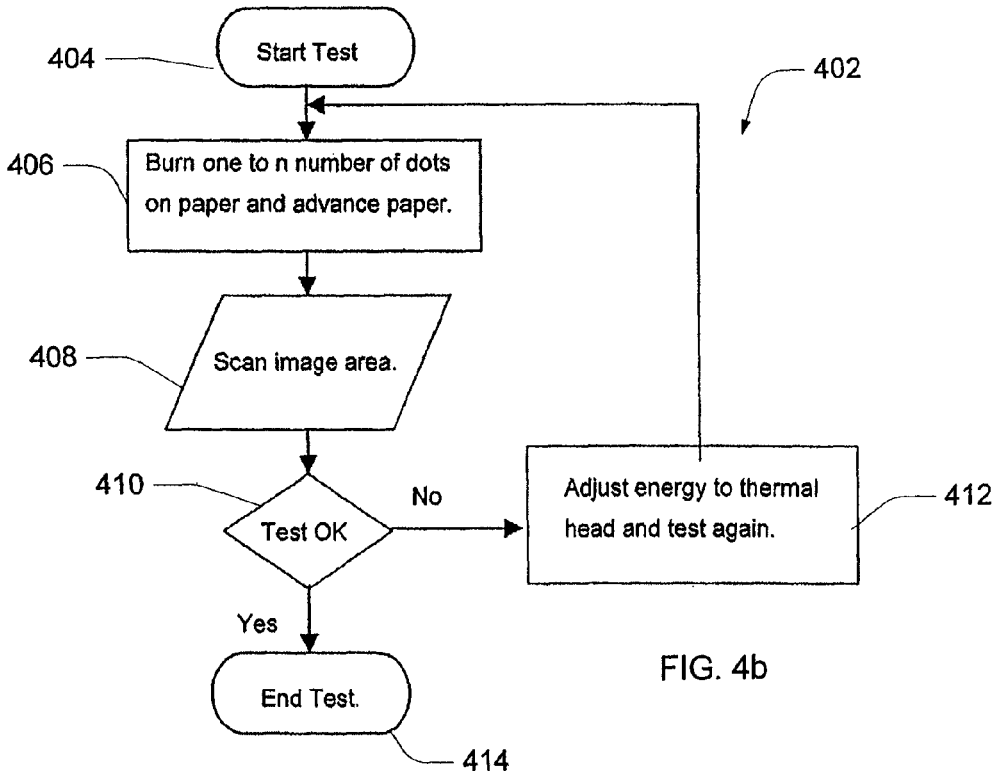
FIG. 4*b* is a process flow diagram of a calibration process in accordance with an exemplary embodiment of the present invention.

FIG. 4*a* and FIG. 4*b* are a semi-schematic view and a process flow diagram respectively of a calibration process in accordance with an exemplary embodiment of the present invention. The calibration process may be used by a gaming machine printer to determine the correct power levels to apply to each thermal element in the thermal print mechanism to ensure a legible voucher.

Referring now to FIG. 4*a*, a gaming machine printer causes a thermal print mechanism 314 to generate a test pattern 400 on a voucher 114. The test pattern may be scanned by the gaming machine printer using an optical scanning device 324. Referring now to FIG. 4*b*, a calibration process 402 starts (404) by burning (406) one or more dots or pixels onto a voucher, thus creating a test image area. The gaming machine printer advances the voucher to the optical scanning device. The gaming machine printer scans (408) the image area searching for the pixels that the thermal print mechanism should have made on the voucher. If the results of the scan indicate (410) that the diagnostic test was not successful, (for example, the test image may be too faint or too dark) the gaming machine printer adjusts (412) the energy supplied to the thermal print mechanism. By increasing the energy supplied, each printed dot or pixel becomes darker on the voucher. By lowering the energy level, each dot or pixel becomes lighter. The gaming machine printer repeats the calibration test until the dots or pixels are printed properly and then the calibration process ends (414).

Figure 5:
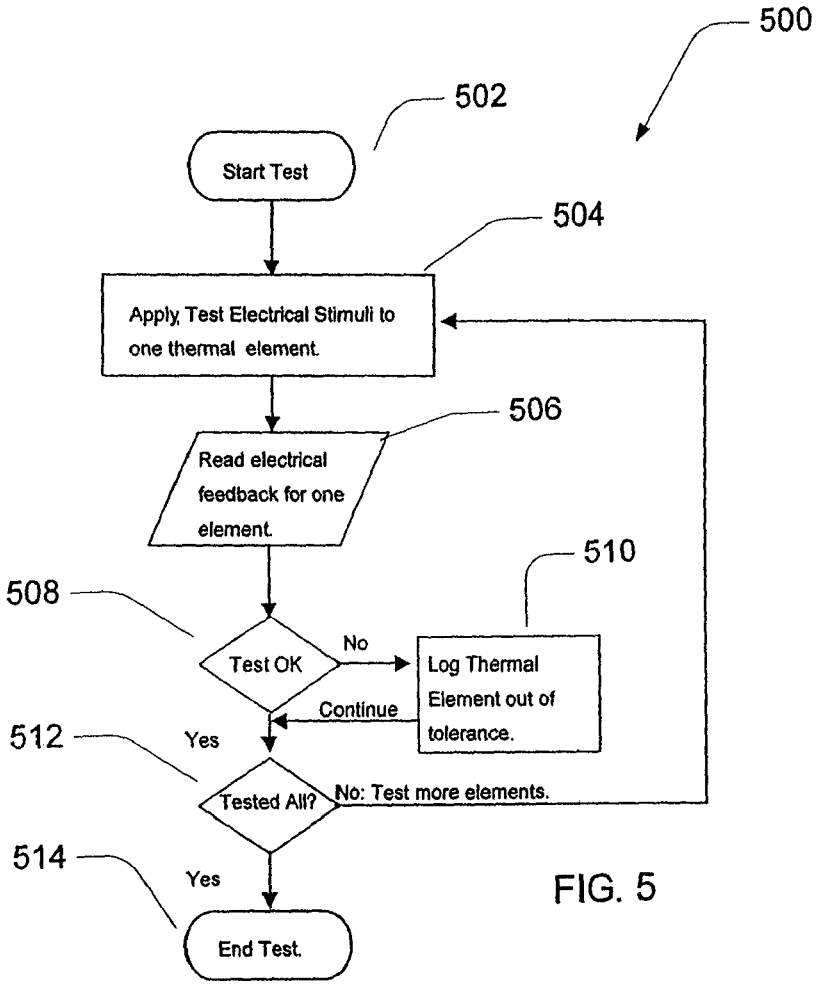
FIG. 5 is a process flow diagram of a thermal print mechanism thermal element diagnostic process in accordance with an exemplary embodiment of the present invention.

FIG. 5 is a process flow diagram of a thermal print mechanism thermal element diagnostic process in accordance with an exemplary embodiment of the present invention. A gaming machine printer includes the mechanical means, electrical means, electronic means, and computer algorithms to perform a self-test on each thermal element of the thermal print mechanism in order to determine the condition of each thermal element. The gaming machine printer performs a thermal element diagnostic process 500 by applying an electrical stimulus to each of the thermal elements. The electrical stimulus is not great enough to cause imaging to occur on a voucher yet generates a corresponding diagnostic electrical feedback signal. For example, the printer controller may apply a known current across a thermal element and monitor the resultant voltage drop. As another example, the printer controller may apply a pulse of current to a thermal element and monitor a thermal print head including the thermal element for a corresponding thermal pulse. The gaming machine printer may then utilize the results of the test to self-calibrate the amount of energy or power applied to a thermal element to produce a continuing high-quality of print.

The gaming machine printer starts (502) the diagnostic process by applying (504) a test electrical stimuli to one thermal element in the thermal print mechanism. The gaming machine printer reads (506) a resultant electrical feedback signal for the stimulated thermal element. The gaming machine printer analyzes the resultant electrical feedback signal to determine (508) if the thermal element tested properly. For example, the gaming machine printer may have a memory store including a range of feedback signal values that are acceptable. If the resultant feedback signal value does not fall within the acceptable range, then the gaming machine printer generates (510) a log entry in a memory store indicating that the thermal element is out of tolerance. The gaming machine printer continues the testing process until (512) all of the thermal elements in the thermal print mechanism have been tested. Once all of the thermal elements have been tested, the gaming machine printer ends (514) the diagnostic process.

Existing printers include communications ports used as native ports solely for communication with other devices, such as a game controller. These native ports are disconnected from the game controller prior to performing a separate function, such as updating printer software or checking the status of the printer. In a gaming machine printer in accordance with an exemplary embodiment of the present invention, the gaming machine printer includes both native ports coupled to a game controller and an additional communications port, herein termed a primary second port, for communications with external devices.

The cashless enabled game represents a trusted host for a gaming machine printer, and the communications protocol between the cashless enabled game and gaming machine printer may vary between game manufacturers. In order for the gaming machine printer to communicate with the cashless enabled games, the gaming machine printer is cognizant of multiple communication protocols required by the cashless enabled games, and the printer is capable of recognizing a cashless enabled game coupled to the gaming machine printer through a communications port as a trusted host.

The gaming machine printer also provides a primary second communication port and automatically disconnects the gaming machine printer from the native communication port (s) when a plug, compatible with the primary second port, is inserted into the primary second port. In addition, the gaming machine printer detects the connection to the primary second communication port, remembers that the connection was completed, and reports the connection event to a trusted host after communications are restored to the trusted host. The gaming machine printer only allows trusted communications to occur through the primary second port as the primary second port normally is used for downloading and or uploading information to and from the gaming machine printer without removing the gaming machine printer from the game, thus providing in-place servicing features.

Figure 6:
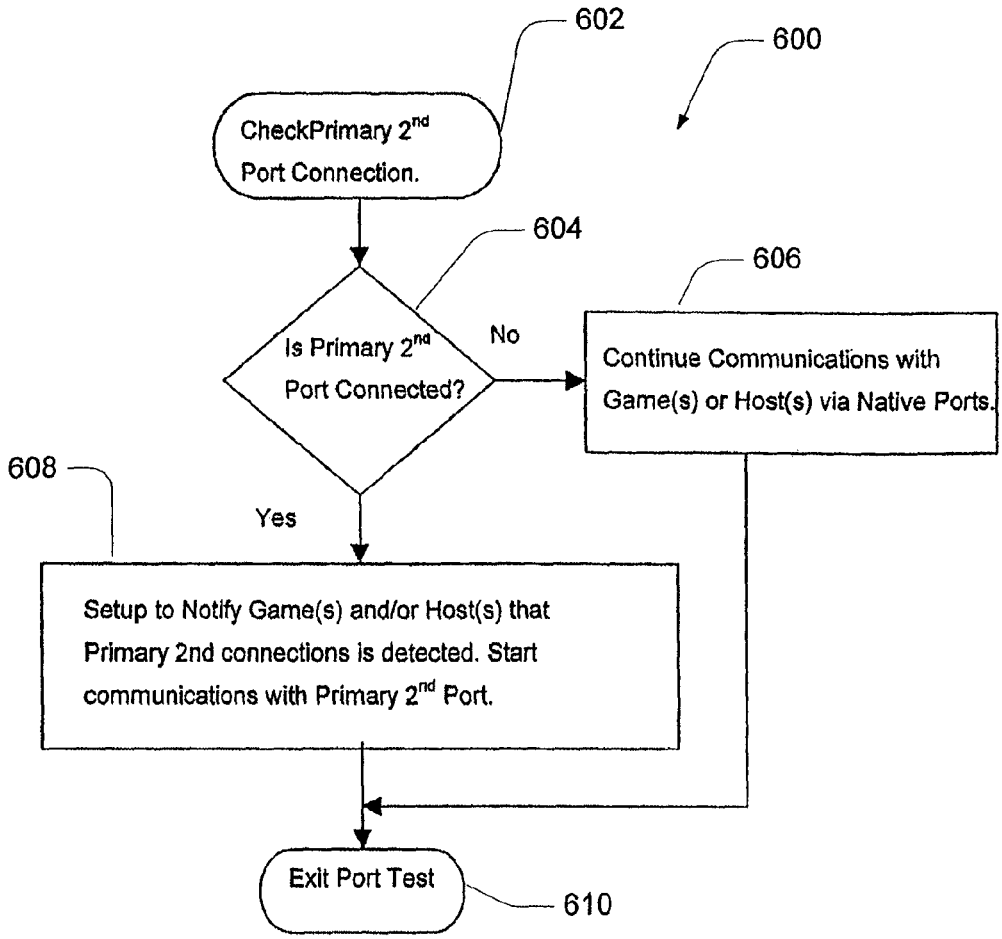
FIG. 6 is a process flow chart of a primary second port test process in accordance with an exemplary embodiment of the present invention.

FIG. 6 is a process flow chart of a primary second port test process in accordance with an exemplary embodiment of the present invention. A primary second port test process 600 is used by a gaming machine printer to detect the presence of a device coupled to the primary second port, communicate with the device, and report the communication event to the cashless enabled game. The process starts by checking (602) the primary second port to determine if a device is connected to the primary second port. If the gaming machine printer determines (604) that no device is connected to the primary second port, then the gaming machine printer continues (606) communications with the cashless enabled game or host using the gaming machine printer's native port. If a device is detected on the primary second port, the gaming machine printer notifies (608) the game or host that a device was detected and establishes communication session with the device using the primary second port. When the communications session is over, the gaming machine printer exits (610) the primary second port test process.

In an embodiment of a gaming machine printer, a plurality of communication ports are provided. Each of the communications ports provides either a native port or a primary second port using a specific communication protocol. As a native port, each communication port may communicate with games and other hosts in the game's or host's native language. In addition, each of the communications ports may be used as a primary second port to download and upload to and from the games and other hosts. The ports could be anyone or more of serial, parallel, Universal Serial Bus (USB), 'Ethernet or other types of communication port(s).

Figure 7:
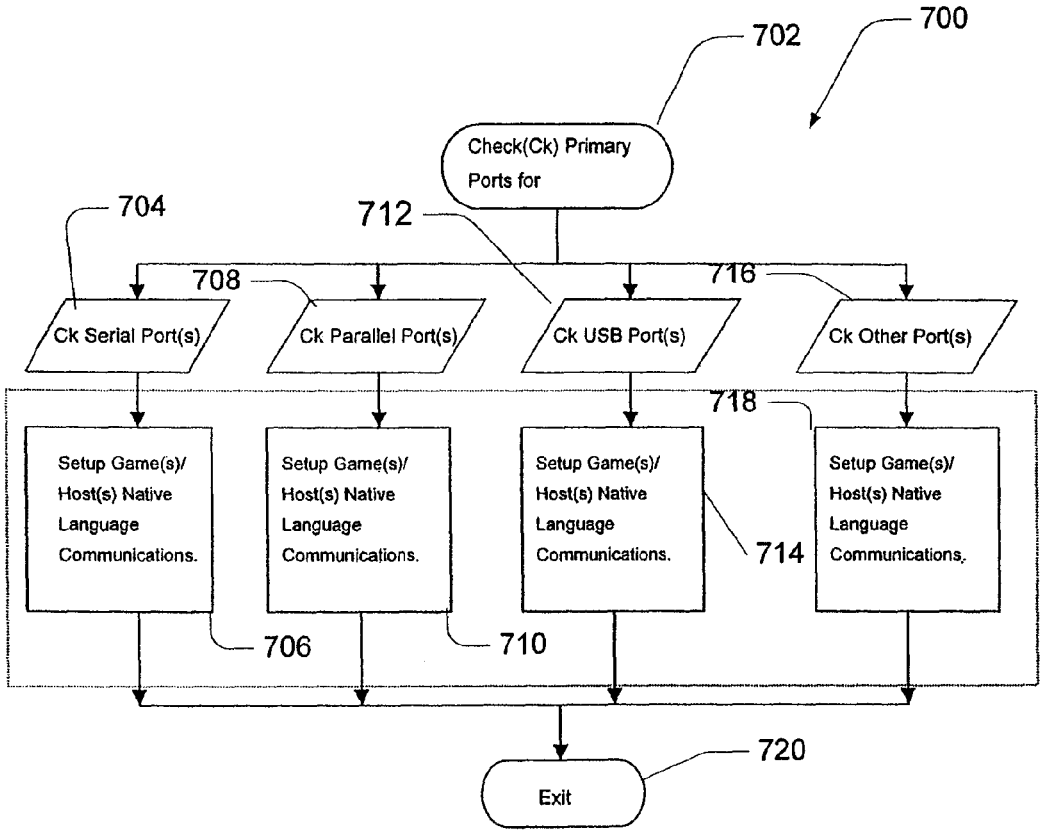
FIG. 7 is a process flow diagram of a native port check process for identifying a communication port to use as a native port in accordance with an exemplary embodiment of the present invention.

FIG. 7 is a process flow diagram of a native port check process for identifying a communication port to use as a native port in accordance with an exemplary embodiment of the present invention. The native port check process is used by a gaming machine printer to identify which port should be used as a native port to communicate with a cashless enabled game. The process may be initiated when a gaming machine printer is first placed into a cashless enabled game, such as a "hot" plug in, or when the gaming machine printer is first powered up.

A native port check process 700 begins by the gaming machine printer checking (702) for communication signals on each of a plurality of communication ports. The process determines if a device is using a communication port by checking (704) to see if communication signals are present on a serial port. If so, the gaming machine printer sets up (706) to communicate or establishes a communication session through the serial port as a native port to the cashless enabled game. Once the setup process is completed, the native port check process is exited (720). In a like manner, the gaming machine printer also checks (708) a parallel port by checking for communications signals on the parallel port. If communication signals are detected, the gaming machine printer sets up (710) the parallel port as a native port for communications with the cashless enabled game in the game's native communications protocol. The gaming machine printer may also check (712) a Universal Serial Bus (USB) port by attempting to detect communications signals on the USB port. If communications signals are detected, the gaming machine printer sets up (714) for communications on the USB port as a native port for the cashless enabled game. In general, the gaming machine printer checks (716) for communications signals on each of the plurality of communications ports provided by the gaming machine printer. If communications signals are detected by the gaming machine printer on a port, the gaming machine printer chooses that port as the native port for communication with a cashless enabled game and sets up (718) the chosen communications port for communications in the native language of the cashless enabled game.

Figure 8:
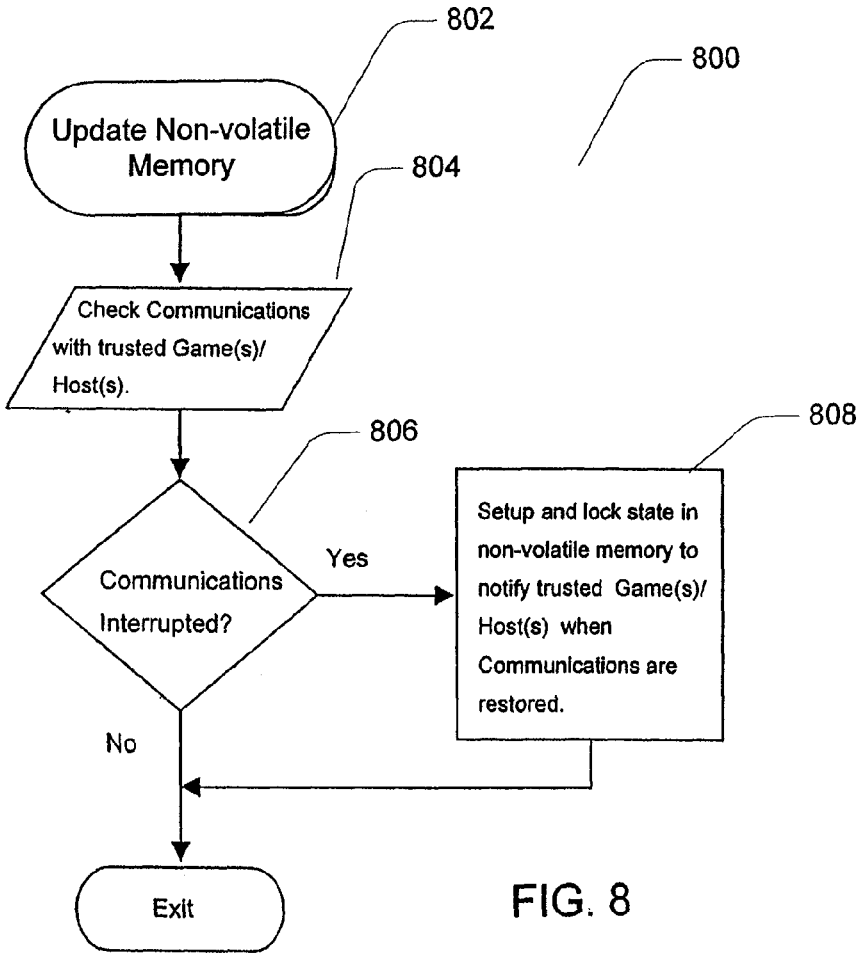
FIG. 8 is a process flow diagram of a status reporting process employing nonvolatile memory storage to store and report printer status in accordance with an exemplary embodiment of the present invention.

FIG. 8 is a process flow diagram of a status reporting process employing nonvolatile memory storage to store and report printer status in accordance with an exemplary embodiment of the present invention. A nonvolatile memory is used in gaming machine printers in a cashless gaming machine to remember printer status or to attempt to re-constitute a partially printed voucher in the case of a power failure. The gaming machine printer may also use the nonvolatile memory to announce to a trusted game or other host that the gaming machine printer was removed. Such a removal may be for an unauthorized purpose such as an attempt to reset the status of the gaming machine printer or perform other unauthorized activities.

In a status reporting process 800, a nonvolatile memory coupled to a gaming machine printer is continuously updated (802) by storing the status of the gaming machine printer in the nonvolatile memory. The gaming machine printer checks (804) the communication status of the gaming machine printer to a cashless enabled game or other host. If the gaming machine printer determines (806) that the state of communication link indicates that the communication link is interrupted, the gaming machine printer sets-up(808) the nonvolatile memory to lock in the state of the gaming machine printer. When communications are reestablished with the cashless enabled game or other host, the gaming machine printer notifies the cashless gaming printer or host that the gaming machine printer lost communications with the cashless gaming machine or host. The gaming machine printer may then transmit a status report the cashless gaming machine or host.

Figure 9:
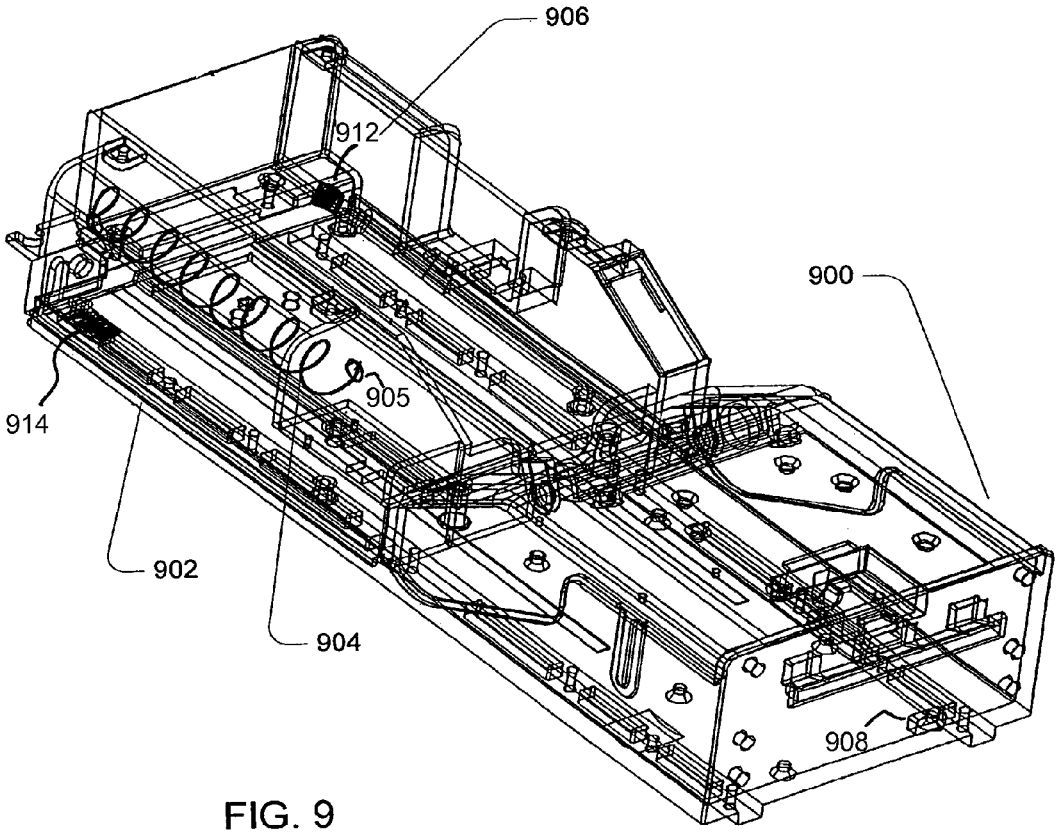
FIG. 9 is a perspective wireline drawing of a gaming machine printer having a coiled electrical cable in accordance with an exemplary embodiment of the present invention.

FIG. 9 is a perspective wireline drawing of a gaming machine printer having a coiled electrical cable in accordance with an exemplary embodiment of the present invention. The gaming machine printer includes a mobile module 900 slidably and removably coupled to a stationary module 902. In prior printer configurations, the stationary module may be connected to the mobile module by a ribbon cable of a wiring harness. The mobile module is routinely accessed by an attendant wherein the mobile module is moved in a sliding motion relative to the stationary module for maintenance and replenishing a supply of blank vouchers held in a storage area 906 of the printer. As the printers may be accessed multiple times during a day, thus generating excessive wear on ribbon cables and wiring harness that were never intended for a high frequency of flexing.

In one embodiment of a gaming machine printer in accordance with the present invention, a coiled electrical cable 904 is used to connect the mobile module to the stationary module. The coiled electrical cable includes power, communication, and other signals required for the operation of the mobile module and the stationary module included in the gaming machine printer. As the coiled electrical cable, similar to a coiled cable connecting a telephone handset to its base, is designed to be flexible, the coiled cable does not experience excessive wear during repeated accesses by an attendant.

In another embodiment of a gaming machine printer in accordance with the present invention, the coiled cable is hot-swappable. In this embodiment, the gaming machine printer includes a hot-swap power controller (not shown) that senses when the cable is being attached to, or removed from, the gaming machine printer. In addition, a connector 905 coupling the gaming machine printer to the cable includes a grounding pin (not shown) that extends further from the base of the connector than any power supply or data pins. This ensures the gaming machine printer is grounded through the connector before any power is applied to the gaming machine printer.

A front portion of the gaming machine printer may be used as a mount for a decorative bezel (not shown) or an active device. To facilitate use of either, a switched power connector 908 is provided on the front portion. A bezel or active device may use the power connector to power motors, circuits, lights, or other powered elements.

The storage area 906 includes an opening 912 aligned with an optical sensor mounted on a printed circuit board (not shown) housed within the gaming machine printer. The optical sensor is used to detect the presence of vouchers within the storage area.

The gaming machine printer further includes one or more openings 914 in a bottom portion of the gaming machine printer's housing. These openings provide drainage for any liquids that may find its way into the housing. Furthermore, the printed circuit board within the housing is held in a spaced apart relationship with an bottom interior surface of the housing in order to reduce the amount of contact the printed circuit board may have with any liquid flowing out of the housing through the drainage openings.

Figure 10:
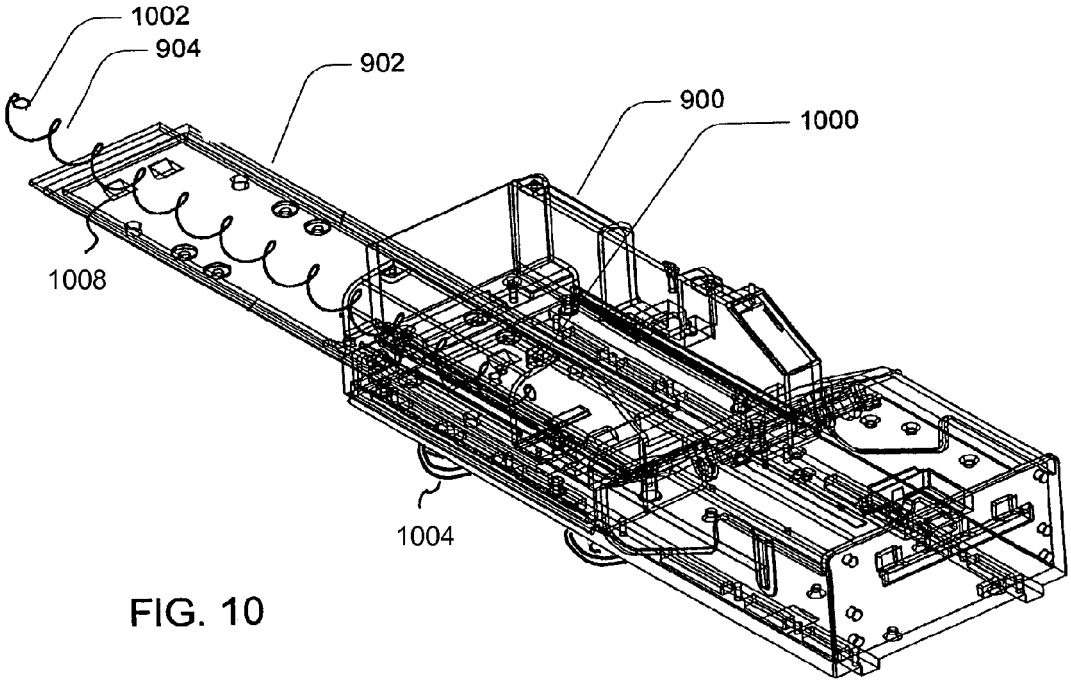
FIG. 10 is a perspective wireline drawing of a gaming machine printer having a coiled cable and in an extended position in accordance with an exemplary embodiment of the present invention.

FIG. 10 is a perspective wireline drawing of a gaming machine printer having a coiled cable and in an extended position in accordance with an exemplary embodiment of the present invention. A gaming machine printer includes a mobile module 900 slidably and removably coupled to a stationary module 902. The gaming machine printer is coupled to a cashless gaming machine via a coiled cable 904 shown in an extended position.

The coiled cable may be removably coupled to the mobile module by separable connector 1000. The coiled cable may also include a separable connector 1002 used to couple the coiled cable to the cashless gaming machine. The connectors are designed to be disconnected and connected routinely, thereby improving reliability and decreasing the maintenance cost associated with a gaming machine printer.

The mobile module includes one or more grounding tabs 1004. The grounding tabs may be flat springs composed of an electrically conductive material that engage with a conductive mounting surface (not shown) to which the stationary module is mounted. In operation, the mobile module is mated to the stationary module and slid into position with the grounding tabs in contact with the conductive mounting surface. This ensures the mobile module is grounded while it is in position. The mobile module is held at various locations on the stationary module by indentions 1008 that mate with a spring element having curved fingers (not shown).

Figure 16A:
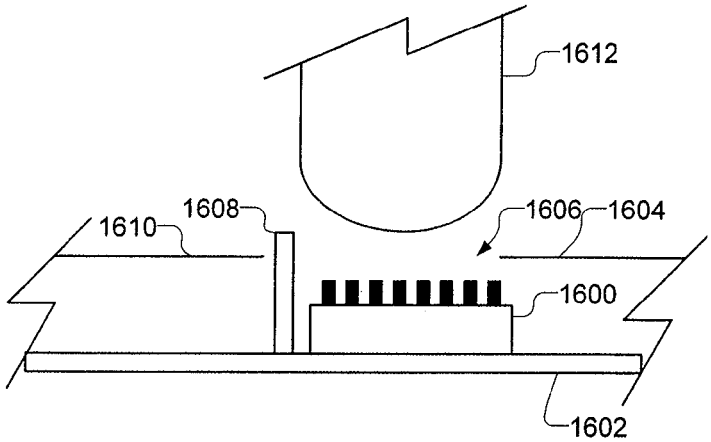
FIG. 16*a* is a side view of an electrostatic discharge pin and user accessible switch in accordance with an exemplary embodiment of the present invention.
Figure 16B:
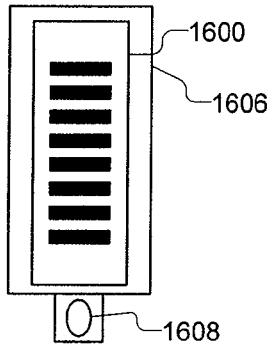
FIG. 16*b* is a top view of an electrostatic discharge pin and user accessible switch in accordance with an exemplary embodiment of the present invention.

FIG. 16*a* is a side view and FIG. 16*b* is a top view of an electrostatic discharge pin and user accessible switch in accordance with an exemplary embodiment of the present invention. In FIG. 16*a* and FIG. 16*b*, like numbered elements indicate similar features of the user accessible switch and electrostatic discharge pin. Such discharge pins protecting user accessible devices are desirable in instances where the gaming machine printer has a housing composed of a non-conductive material. A user accessible device such as a switch 1600 is mounted on a printed circuit board 1602. The user accessible device may be a dip switch or other switch that a user uses to affect changes in the printer's configuration. The switch is housed within the gaming machine printer and protected by an outer housing 1604 having an opening 1606 through which the user may access the switch. An electrostatic discharge pin 1608 extends from the printed circuit board alongside the switch and protrudes above an upper surface 1610 of the housing. The electrostatic discharge pin is composed of an electrically conducting material and is operable to conduct an electric current around the switch to ground such as through a grounding plane or other circuit within the printed circuit board. The electrostatic discharge pin is located in close proximity to the switch such that, in order to actuate the switch, a distal portion of a user's digit 1612 first comes into close or actual contact with the electrostatic discharge pin. In doing so, any electrostatic charge held by the user will be drained to ground through the electrostatic discharge pin and not into the switch.

Figure 11:
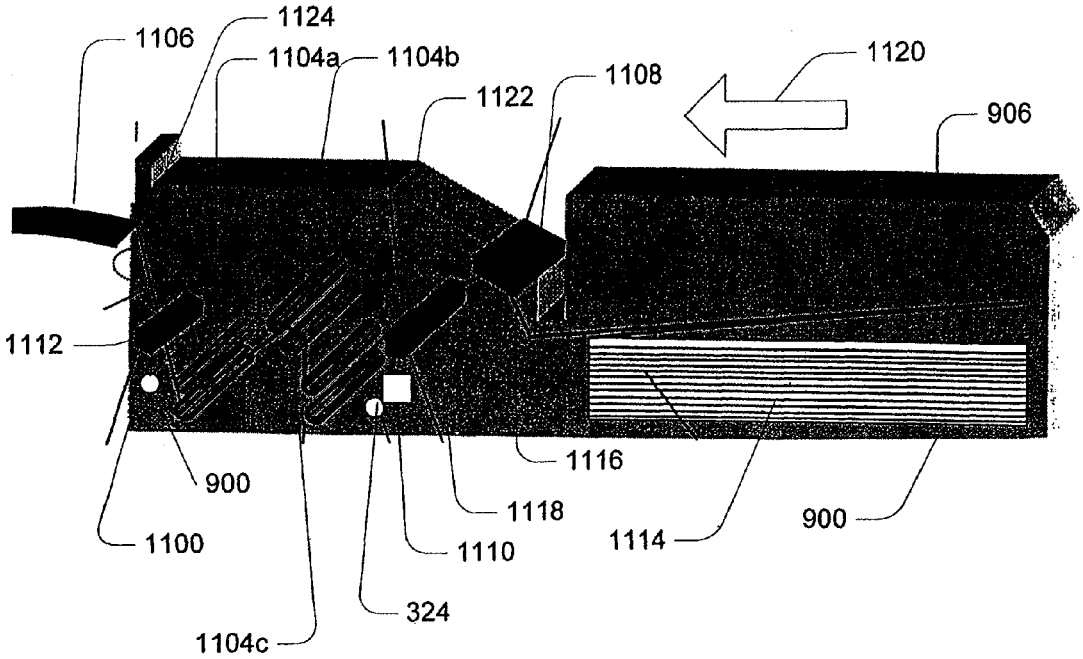
FIG. 11 is a semi-perspective drawing of a gaming machine printer including a voucher path management system in accordance with an exemplary embodiment of the present invention.

FIG. 11 is a semi-perspective drawing of a gaming machine printer including a voucher path management system in accordance with an exemplary embodiment of the present invention. A gaming machine printer includes a mobile module 900 having a sub-module 1100 housing the components of a voucher path management system. The components include a series of pinch rollers, 1104*a*, 1104*b*, and 1104*c*, covered in a flexible material, with accompanying mechanical guides. The pinch rollers and mechanical guides provide a serpentine path for a voucher 1106 as the voucher is being printed. The pinch rollers pull the voucher through the voucher path management system as the voucher is being printed by the thermal print head mechanism 1108. The overall length of the serpentine path is such that a voucher can be held within the voucher path management system after a voucher has been fully printed.

Vouchers used in a cashless gaming machine are approximately the size of a dollar bill, and are commonly referred to as dollar bill vouchers. Blank vouchers 1114 may be stored in a voucher bin area 906 of the mobile module. The blank vouchers are perforated, for easy separation, and fan folded in packs containing quantities of several hundred blank vouchers. Vouchers are made from thermally reactive stock that is designed to be used in a thermal printer.

To load a blank voucher into the gaming machine printer, the blank voucher is manually feed into a receiver slot 1116 on a rear side of the thermal print mechanism. The thermal print mechanism self-feeds the blank voucher into a position in the thermal print mechanism such that the blank voucher is ready to be printed.

On receiving a print request from the cashless gaming machine or other host, the gaming machine printer begins printing a voucher. The gaming machine printer generates an image to be printed on the voucher and operates the thermal print mechanism in a manner that creates the image on the thermally reactive paper.

As the print job progress, the voucher is moved from the thermal print mechanism toward a burster bar 1118, being guided along the way by mechanical guides. The mechanical guides cause the voucher to be engaged in the pinch rollers that are motor driven and continue to move the voucher in the indicated direction 1120.

The thermal print mechanism, the pinch rollers and the mechanical guides all function together in such a way that the completely printed voucher is held inside of the mobile module of the gaming machine printer. In addition, the voucher perforation is stopped at a point 1122 just past the burster bar.

After the successful completion of a voucher printing step, the gaming machine printer is ready to eject the voucher. To do so, the thermal print mechanism ceases to move the voucher while the pinch rollers continue to move the voucher toward the ejection point 1124. As tension builds at the voucher perforation, located near the burster bar, the completed voucher bursts away from the blank voucher to its rear. The pinch rollers move the completed voucher out through the ejection slot and the completed voucher is held in this position awaiting hand removal.

The voucher path management system may further include an optical scanning device 324 and a paper sensor 1110. The optical scanning device may be used by the gaming machine printer to validate a printed voucher or verify the quality of the imaging on the thermally reactive paper of the voucher as previously described. If the voucher cannot be validated or the print quality is poor, the gaming machine printer may hold the invalid voucher within the voucher path management system until an attendant can clear the invalid voucher from the gaming machine printer. The voucher path management system may further include a heating bar 1112 for voiding an invalid voucher. In operation, the gaming machine printer may pass an invalid voucher by the heating bar as the invalid voucher is ejected. Heat generated by the heating bar causes thermally sensitive inks in the voucher to be completely activated, thus obscuring any previously printed information on the invalid voucher. Alternatively, as the voucher path management system holds the voucher completely at the end of the printing step, the gaming machine printer is capable of retracting the invalid voucher back into the thermal printing mechanism and printing a "void" image over any statements on the invalid voucher. The voided voucher would either be held for manual retrieval or ejected. In addition, the gaming machine printer may notify the cashless gaming machine or other host of the invalid voucher. The gaming machine printer may then void the voucher in response to a remote command or through local logic.

Figure 12:
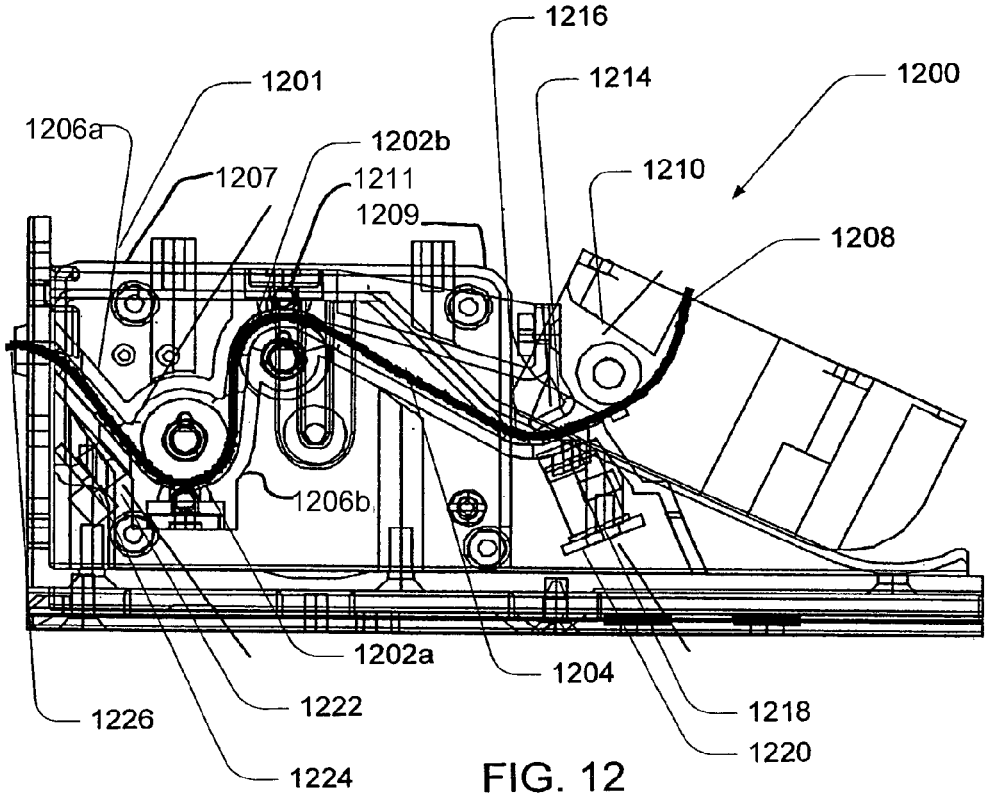
FIG. 12 is a side view wireline drawing of a gaming machine printer including a voucher path management system in accordance with an exemplary embodiment of the present invention.

FIG. 12 is a side view wireline drawing of a gaming machine printer including a voucher path management system in accordance with an exemplary embodiment of the present invention. In the depicted gaming machine printer mobile module 1200, the voucher path management system 1201 includes two pinch rollers 1202*a* and 1202*b*. The rollers define a serpentine path 1204 with the aid of an upper voucher guide 1206*a* and a lower voucher guide 1206*b* for the passage of a voucher through the voucher path management system.

The pinch rollers and mechanical guides provide a serpentine path for a voucher 1208 as the voucher is being printed. The pinch rollers pull the voucher through the voucher path management system as the voucher is being printed by the thermal print head mechanism 1210. The overall length of the serpentine path is such that a voucher can be held within the voucher path management system after a voucher has been fully printed.

As a print job progress, the voucher is moved from the thermal print mechanism past a burster bar 1214, being guided along the way by the mechanical guides. The mechanical guides cause the voucher to be engaged in the pinch rollers that are motor driven. The thermal print mechanism, the pinch rollers, and the mechanical guides all function together in such a way that the completely printed voucher is held inside of the mobile module of the gaming machine printer. In addition, the voucher perforation is stopped at a point 1216 just past the burster bar.

The voucher path management system may further include an optical scanning device 1218 and a paper sensor 1220. The optical scanning device may be used by the gaming machine printer to validate a printed voucher or verify the quality of the imaging on the thermally reactive paper of the voucher as previously described. The voucher path management system may further include an additional paper sensor 1222 and optical scanning device 1224 adjacent to a ticket ejection slot 1226.

In a voucher path management system in accordance with an exemplary embodiment of the present invention, the upper voucher guide 1206*a* is fixedly attached to an inside surface of a top portion 1207 of an openable clamshell cover. The cover includes a hinge (not shown) at a rear portion 1209 of the cover. A third pinch roller 1211 is mounted transversely within the upper mechanical voucher guide. When the cover is closed, pinch roller 1211 is pressed against pinch roller 1202*b* with the voucher held therebetween. In addition, when the cover is closed, the upper voucher guide forms an upper surface for the serpentine voucher path with the lower voucher guide forming a lower surface.

When the cover is opened, the upper voucher guide, along with pinch roller 1211, comes away along with the cover, opening up the serpentine guide. This allows a user to have unobstructed access to any voucher held in the voucher path management system. Not only does this facilitate clearing of a jammed voucher, it also serves to provide a reassuring view to a player that may be watching a technician retrieve a valuable voucher.

Figure 17A:
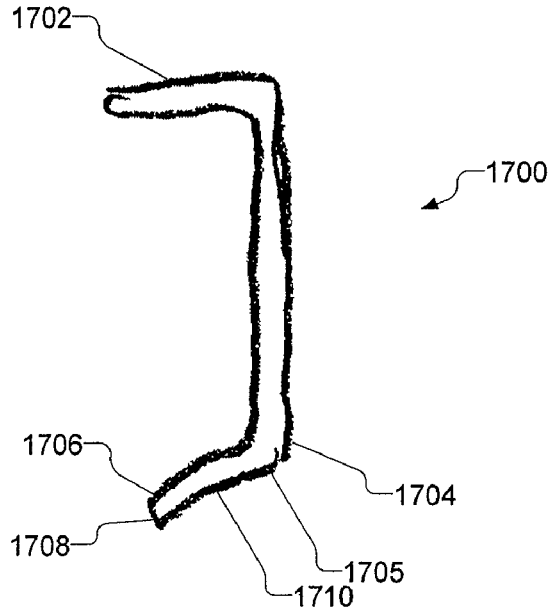
FIG. 17*a* is a side view of a burster bar in accordance with an exemplary embodiment of the present invention.
Figure 17B:
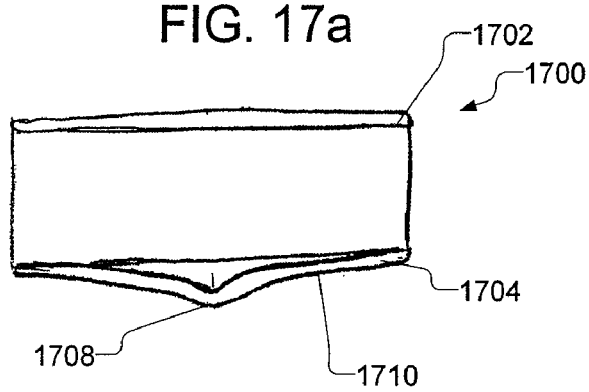
FIG. 17*b* is a front view of a burster bar in accordance with an exemplary embodiment of the present invention.
Figure 17C:
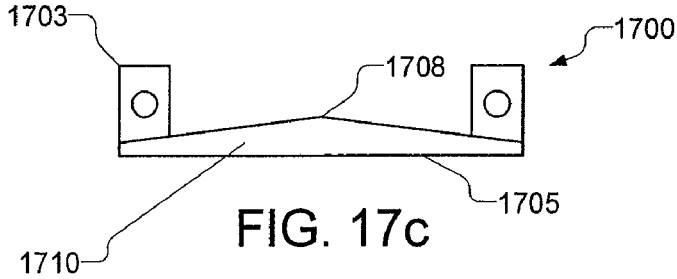
FIG. 17*c* is a bottom view of a burster bar in accordance with an exemplary embodiment of the present invention.

FIG. 17*a* is a side view, FIG. 17*b* is a front view, and FIG. 17*c* is a bottom view of a burster bar in accordance with an exemplary embodiment of the present invention. In FIG. 17*a* to FIG. 17*c*, like numbered elements indicate similar features of the burster bar. Burster bar 1700 includes a top portion 1702 having one or more mounting tabs 1703 for attachment to a gaming machine printer and a free bottom portion 1704 that contacts a voucher during a bursting operation. The bottom portion has a curved leading edge 1705 and a rounded trailing edge 1706. The bottom portion includes a lip 1708 that protrudes downwardly from the trailing edge. Viewed from the side, the lip defines a bottom surface 1710 having a compound curvature with a downwardly sloping component extending from the leading edge to the trailing edge. Viewed from the front, the lip defines a bottom edge sloping downwardly from each side of the burster bar towards a centralized lip. Viewed from the bottom, the protruding lip defines a triangular bottom portion with two sides of a triangle sloping from the leading edge to the trailing edge at joining at the protruding lip. In operation, the protruding lip serves as a pressure point to separate a voucher from a subsequent voucher at a perforated junction as previously described.

Figure 13:
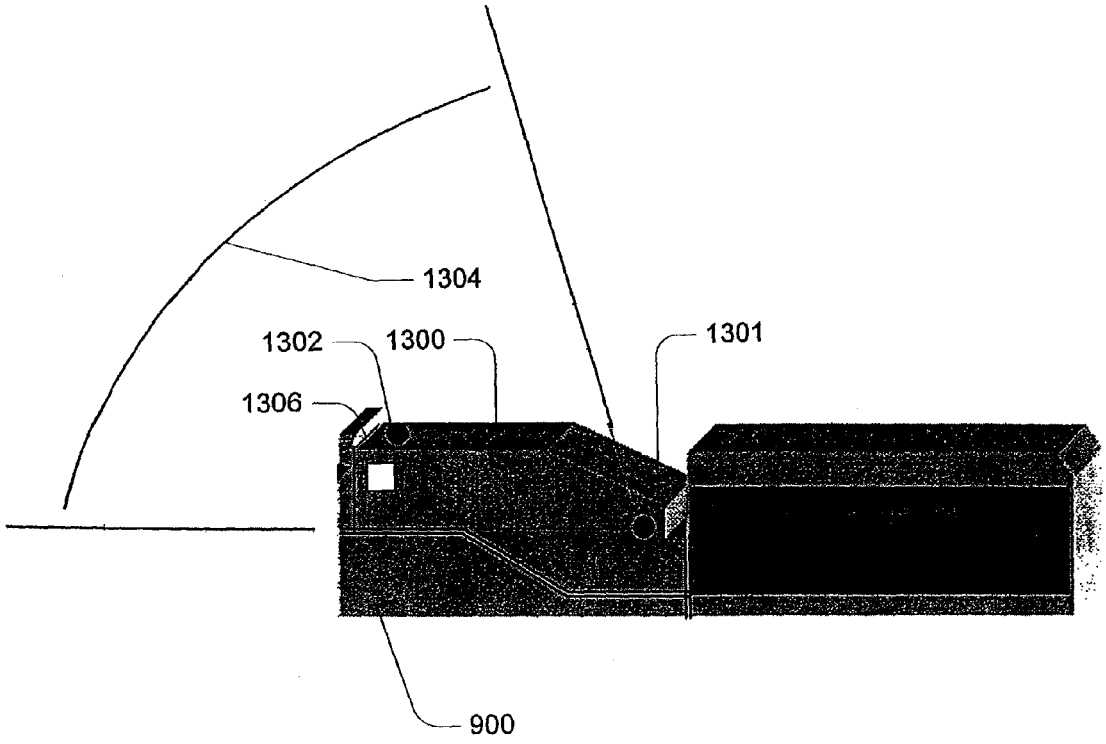
FIG. 13 is semi-perspective drawing of a gaming machine printer including a mobile module with a hinged sub-module in accordance with an exemplary embodiment of the present invention.

FIG. 13 is semi-perspective drawing of a gaming machine printer including a mobile module with a hinged sub-module in accordance with an exemplary embodiment of the present invention. The gaming machine printer's mobile module 900 includes a sub-module 1300 moveably coupled to the mobile module by a hinge 1301. The sub-module is secured closed by a mechanical latching mechanism 1302. Upon releasing the latch, the sub-module is capable of pivoting away from the mobile module as illustrated by the movement arc 1304. A sensor 1306 is located on the mobile module to detect whether the sub-module is open or closed. The gaming machine printer uses the sensor to detect when the sub-module is open and can notify the cashless gaming machine or other host that the sub-module is open, thereby enhancing the overall security of the cashless gaming process. The gaming machine printer, when the sub-module is in the open position, provides access to the internal parts of the gaming machine printer, thereby simplifying routine maintenance and removal of obstructions, such as miss-fed vouchers inside of the gaming machine printer.

Figure 14:
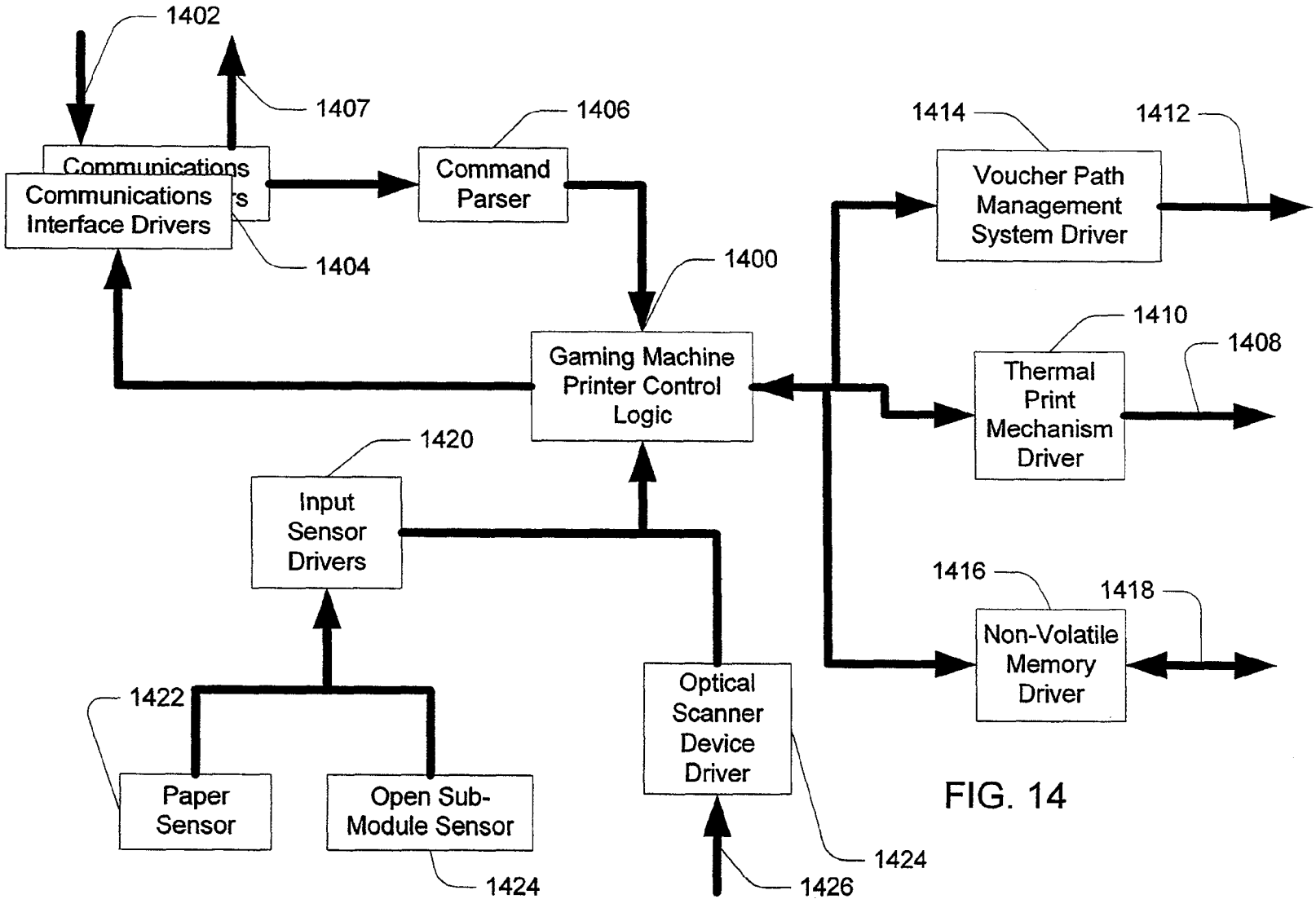
FIG. 14 is a software module diagram of a gaming machine printer controller in accordance with an exemplary embodiment of the present invention.

FIG. 14 is a software module diagram of a gaming machine printer controller in accordance with an exemplary embodiment of the present invention. A gaming machine printer controller has a gaming machine printer control logic module 1400 that includes the logic for previously described gaming machine printer functions. The gaming machine printer receives input communications signals 1402 from a cashless enabled game or other host. The communications signals may come from a variety of communications devices as previously described. The communications signals are received by the gaming machine printer using a plurality of communications device drivers 1404. The input communications signals may contain commands which are parsed using a command parser module 1406. The gaming machine printer control logic may also use the communications interface drivers to generate and transmit output communications signals 1407 to the cashless enabled game or host.

In response to the parsed commands, the gaming machine printer control logic generates thermal print mechanism drive signals 1408 using a thermal print mechanism driver 1410. As previously described, the thermal print mechanism drive signals may instruct the thermal print mechanism to print a voucher, void a voucher, print a test pattern, adjust the power levels of an individual thermal element, etc. The gaming machine printer control logic also generates voucher path management system signals 1412 using a voucher path management system driver 1414. The voucher path management system signals instruct the components of the voucher path management system to hold a voucher, burst a voucher, retract a voucher, etc. as previously described.

The gaming machine printer control logic uses a nonvolatile memory driver 1416 to write and read gaming machine printer status signals 1418 stored in a nonvolatile memory. The status signals may be transmitted to a cashless enabled game or host or used internally by the gaming machine printer control logic as previously described.

The gaming machine printer control logic uses an input sensor driver 1420 to read input sensors such as a paper sensor 1422 and an open sub-module sensor 1424. The paper sensor may be used to detect the presence or absence of vouchers and the open sub-module sensor may be used to detect an open sub-module as previously described.

The gaming machine printer control logic uses an optical scanner device driver 1424 to receive scanned voucher signals 1426. The gaming machine printer control logic uses the scanned voucher control signals to verify or validate a voucher or to calibrate the thermal print mechanism as previously described.

Figure 15:
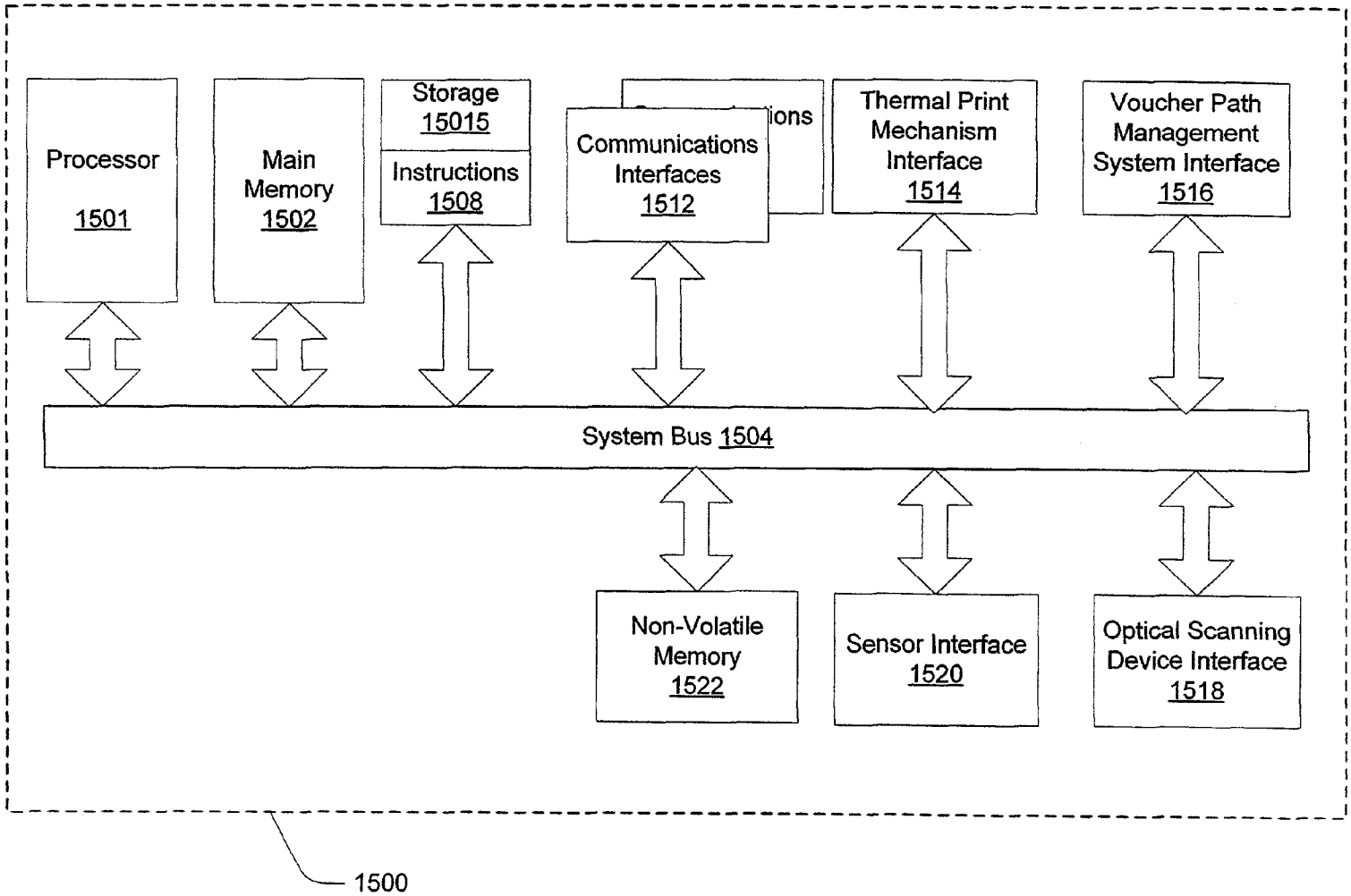
FIG. 15 is an architecture diagram for a data processing system suitable for use as a gaming machine printer controller host in accordance with an exemplary embodiment of the present invention.

FIG. 15 is an architecture diagram for a data processing system suitable for use as a gaming machine printer controller host in accordance with an exemplary embodiment of the present invention. A gaming machine printer controller host 1500 includes a processor 1501 coupled to a main memory 1502 via a system bus 1504. The processor is also coupled to a data storage device 1506 via the system bus. The storage device includes programming instructions 1508 implementing the features of a gaming machine printer as described above. In operation, the processor loads the programming instructions into the main memory and executes the programming instructions to implement the features of the gaming machine printer as previously described.

The data processing system may further include a plurality of communications device interfaces 1512 coupled to the processor via the system bus. A gaming machine printer controller, hosted by the data processing system, uses the communications device interfaces to communicate with a cashless gaming machine or other host as previously described.

The data processing system may further include a thermal print mechanism interface 1514 coupled to the processor via the system bus. A gaming machine printer controller, hosted by the data processing system, uses the thermal print mechanism interface to generate control signals for a thermal print mechanism and receive electrical feedback signals as previously described.

The data processing system may further include a voucher path management system interface 1516 coupled to the processor via the system bus. A gaming machine printer controller, hosted by the data processing system, uses the voucher path management system interface to generate control signals for a voucher path management system as previously described.

The data processing system may further include an optical scanning device interface 1518 coupled to the processor via the system bus. A gaming machine printer controller, hosted by the data processing system, uses the optical scanning device interface to receive voucher scan signals from an optical scanning device as previously described.

The data processing system may further include a sensor interface 1520 coupled to the processor via the system bus. A gaming machine printer controller, hosted by the data processing system, uses the sensor interface to receive sensor signals from various components of a gaming machine printer as previously described.

The data processing system may further include a nonvolatile memory interface 1522 coupled to the processor via the system bus. A gaming machine printer controller, hosted by the data processing system, uses the nonvolatile memory interface to store and retrieve gaming machine printer status signals as previously described.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supported by this application and the claims' equivalents rather than the foregoing description.

What is claimed is:

1. A voucher path management system for a gaming machine printer, comprising:

a mobile module having a lower voucher guide; and an openable sub-module moveably coupled to the mobile module, the sub-module comprising:

an upper voucher guide fixedly attached to an inner surface of the openable sub-module, the lower voucher guide and the upper voucher guide defining a voucher path therebetween when the sub-module is in a closed position whereby the upper voucher guide may be separated from the lower voucher guide when the sub-module is in an open position, thereby exposing a voucher in the voucher path management system; and a print mechanism fixedly attached to the inner surface of the sub-module, the print mechanism printing the voucher and moving the voucher into the voucher path.

2. The voucher path management system for a gaming machine printer of claim 1, wherein the voucher path is serpentine, wherein the lower voucher guide is defined by one or more pinch rollers in the mobile module, and wherein the upper voucher guide further comprises an additional pinch roller mounted transversely within the upper voucher guide such that, when the openable sub-module is in the closed position, the additional pinch roller is pressed against at least one of the one or more pinch rollers with the voucher held therebetween.

3. The voucher path management system for a gaming machine printer of claim 2 wherein the overall length of the voucher path is such that the voucher can be held within the voucher path management system after the voucher has been fully printed.

4. The voucher path management system for a gaming machine printer of claim 3 wherein the voucher held within the voucher path management system is entirely exposed and held by the lower voucher guide when the sub-module is in the open position.

5. The voucher path management system for a gaming machine printer of claim 2, wherein the openable sub-module further comprises a burster bar fixedly attached to the inner surface of the openable sub-module, the burster bar located between the print mechanism and the upper voucher guide, and wherein the one or more pinch rollers defining the lower voucher guide are motor driven such that the one or more pinch rollers continue to move the voucher toward an ejection point of the voucher guide as the print mechanism ceases to move the voucher, thereby tensioning a perforated portion of the voucher against the burster bar for bursting the voucher from an adjoining voucher.

6. The voucher path management system for a gaming machine printer of claim 1 further comprising an optical scanning device for scanning the voucher held within the voucher path management system.

7. The voucher path management system for a gaming machine printer of claim 1 further comprising a paper sensor for sensing the voucher held within the voucher path management system.

8. The voucher path management system for a gaming machine printer of claim 1 wherein the openable sub-module further comprises a burster bar fixedly attached to the inner surface of the openable sub-module, the burster bar located between the print mechanism and the upper voucher guide.

* * * * *